US005619859A

United States Patent [19]

Takigawa et al.

[11] Patent Number: 5,619,859

[45] Date of Patent: Apr. 15, 1997

[54] ABSORPTION REFRIGERATION UNIT

[75] Inventors: Takatoshi Takigawa; Mitsuji Kawai, both of Settsu, Japan

[73] Assignee: Daikin Industries, Ltd., Osaka, Japan

[21] Appl. No.: 507,297

[22] PCT Filed: Dec. 26, 1994

[86] PCT No.: PCT/JP94/02218

§ 371 Date: Aug. 25, 1995

§ 102(e) Date: Aug. 25, 1995

[87] PCT Pub. No.: WO95/18344

PCT Pub. Date: Jul. 6, 1995

[30] Foreign Application Priority Data

Dec. 27, 1993 [JP] Japan ..... 5-331279

[51] Int. Cl.[6] ..... F25B 15/00

[52] U.S. Cl. ..... 62/148; 62/497

[58] Field of Search ..... 62/148, 101, 141, 62/476, 497

[56] References Cited

U.S. PATENT DOCUMENTS

| | | | |
|---|---|---|---|
| 4,164,128 | 8/1979 | Newton | 62/105 |
| 4,251,997 | 2/1981 | Newton | 62/101 |
| 4,498,307 | 2/1985 | Hibino et al. | 62/148 |
| 4,706,464 | 11/1987 | Kreutmair | 62/101 |
| 5,156,013 | 10/1992 | Arima et al. | 62/148 |
| 5,477,696 | 12/1995 | Takahata et al. | 62/148 |

FOREIGN PATENT DOCUMENTS

| | | |
|---|---|---|
| 63-251764 | 10/1988 | Japan . |
| 5280824 | 10/1993 | Japan . |

*Primary Examiner*—William Doerrler

*Attorney, Agent, or Firm*—Watson Cole Stevens Davis, P.L.L.C.

[57] ABSTRACT

An absorption refrigeration unit adapted to attain energy-saving by suppressing a surplus refrigerating capacity at the time of a normal operation during which the cooling water temperature is low, improve the response by ensuring adequate heating at the time of start-up operation at which the cooling water temperature is low, and avoid a pressure rise in a generator when the cooling water temperature is high or abnormality occurs. Fundamentally the amount of heat applied by a burner 31*a* is controlled according to the cooled water outlet temperature Tm, while the maximum permissible temperature for a high temperature generator 3 is determined according to the cooled water inlet temperature. When the temperature Tgh in the high temperature generator 3 exceeds the maximum permissible temperature determined by the cooled water inlet temperature, the amount of heat applied is reduced. During the normal operation in which the cooling water temperature is low, the amount of heat applied is reduced. At the start-up operation at which the cooling water temperature is low, sufficient heating is ensured. Further, when the high temperature generator 3 is high in temperature, the amount of heat applied is reduced, irrespective of the cooling water temperature, to avoid a pressure rise.

7 Claims, 2 Drawing Sheets

ABSORPTION REFRIGERATION UNIT

DESCRIPTION

1. Technical Field

The present invention relates to a double effect absorption refrigeration unit which mainly uses water as a refrigerant and an aqueous solution of lithium bromide as an absorbent solution, respectively, and comprises an evaporator, an absorber, a high temperature generator, a low temperature generator and a condenser.

2. Background Art

A conventional absorption refrigeration unit comprises, as disclosed in Japanese patent application laid-open No. Sho 63-251764 and shown in FIG. 3, an evaporator A having a refrigerant applicator I and a water cooling pipe W; an absorber B which is disposed in a single vessel U, adjacent to the evaporator A across an eliminator M, and is provided with a concentrated solution applicator S and a cooling water piping R; a high temperature generator C, which is connected with the absorber B through a solution pump G, a low temperature heat exchanger L and a high temperature heat exchanger H and uses a burner V as a heating source, for generating a refrigerant from a diluted solution into which a large amount of refrigerant has been absorbed by the absorber B; a low temperature generator D, which has a heater K through which refrigerant vapors generated in the high temperature generator C are passed, for generating the refrigerant from the solution of intermediate concentration which has been regenerated by the high temperature generator C and passed through the high temperature heat exchanger H; and a condenser E, which is disposed in a single vessel T together with the low temperature generator D, for condensing the refrigerant vapors, generated in the respective generators C, D, by means of a cooling water piping J arranged in succession to a latter part of the cooling water piping R in the absorber B. The refrigerant spiraled in the evaporator A is evaporated and thereby cooled water to be supplied to a cooling load is taken into the water cooling pipe W.

In the above described construction, an amount of heat applied by the burner V is varied by adjustment of openings of a fuel control valve X, and an outlet temperature of cooled water is detected by temperature detecting means Y provided at an outlet of the water cooling pipe W. The opening of the valve X is controlled via a controller F according to changes of the temperature of the cooled water indicating the cooling load, as shown in FIG. 4. When outside air is equal in temperature but is lower in humidity, a real load decreases and accordingly the amount of heat applied by the burner V can be reduced to attain an energy-saving. Because of this, in the conventional type refrigeration unit, an inlet temperature of the cooling water downstream from an outside cooling tower (not shown), which correlates with a value of humidity, is detected by temperature detecting means Z, so that, when the inlet temperature of the cooling water is low, the change of the opening in relation to the inlet temperature of the cooled water is sloped gently and an upper limit of the openings is reduced to have a small value.

However, with this conventional construction, when the inlet temperature of the cooling water is low, the opening of the fuel control valve X is uniformly regulated to a small degree. Due to this, the amount of heat is governed and restricted by the inlet temperature of the cooling water, even when a related combustion of 100% is desired at for example start-up at which the cooling water is low in temperature, for a quick shift to a normal operation, or when full exertion of capacity is desired for quick response to a rapid increase of load. Due to this, a problem occurs that the capacity can be insufficiently exerted to cause a delay in response.

In addition, the construction, with which the amount of heat in the high temperature generator C is restricted in dependence on the inlet temperature of the cooling water when the inlet temperature of the cooling water is low, can restrict an increase of pressure in the high temperature generator C to some extent, but cannot cope with abnormal conditions, such as the case of air and the like being mixed into a solution piping system or of a large amount of hydrogen gas being generated.

SUMMARY OF THE INVENTION

According to the present invention, a maximum permission temperature of the high temperature generator is in principle determined by an inlet temperature of the cooling water, while the amount of heat is fundamentally controlled according to variations of cooling load, such as an outlet temperature of cooled water. Only when a temperature in the high temperature generator exceeds the maximum permissible temperature determined by the inlet temperature of the cooling water, the amount of heat primarily determined by the cooling load is reduced. The object of the present invention is to provide an absorption refrigeration unit which improves response by ensuring adequate control at the time of start-up operation, attains energy-saving by suppressing a surplus refrigerating capacity when the cooling water is low in temperature, and avoids a pressure rise in the high temperature generator, irrespective of the temperature of the cooling water, when an abnormality occurs, such as the case of a large amount of hydrogen gas being generated.

In order to attain the object, an absorption refrigeration unit according to the invention comprises, as shown in FIG. 1, an evaporator 1 for evaporating a refrigerant to take out a cooled heat to be supplied to cooling load an absorber 2 for absorbing the refrigerant evaporated by the evaporator 1 into a solution; a high temperature generator 3 and a low temperature generator 4 both for generating the refrigerant from the solution into which the refrigerant was absorbed by the absorber 2 a condenser 5 for condensing the refrigerant generated by the generators 3,4 and heating control means 32 for controlling an amount of heat applied by a heat source 31 in the high temperature generator 3 according to variations of the cooling load, said absorption refrigeration unit further comprising first temperature measuring means 7 for measuring a temperature of a cooling water flowing through a cooling water piping 23 arranged in the absorber 2; second temperature measuring means 8 for measuring a temperature of the high temperature generator 3; limit temperature setting means 9 for determining a maximum permissible temperature for the high temperature generator 3 according to variations, large and small, of values measured by the first temperature measuring means 7 and heating restraining means 10 for giving a command for reducing the amount of heat to the heating control means 32 when a value measured by the second temperature measuring means 8 exceeds the maximum permissible temperature set by the limit temperature setting means 9.

In this embodiment, the following devices are used for achieving the object in most typical methods. A burner 31*a* is used as the heat source 31, and a fuel control valve 32*a* of which its opening is adjustable to control a fuel supply to the burner 31*a* is used as the heating control means 32. For a cooling load detecting means there may be used a cooled water outlet temperature detecting means 14 provided at an outlet of a water cooling pipe 11 arranged in the evaporator 1, or means for measuring a difference between an inlet temperature and an outlet temperature of the cooled water flowing through the water cooling pipe 11 arranged in the evaporator 1. Further, cooling water inlet temperature detecting means, for detecting an inlet temperature Tt of the cooling water flowing through a cooling water piping 23 arranged in the absorber 2, may be used for the first temperature measuring means 7.

Where the cooling water inlet temperature detecting means is used for the first temperature detecting means 7, it is preferable that, in order to suitably determine the maximum permissible temperature for the high temperature generator 3 in relation to the inlet temperature of the cooling water, the limit temperature setting means 9 sets the maximum permissible temperature at a value proportional to the inlet temperature Tt of the cooling water when the inlet temperature Tt of the cooling water detected by the first temperature detecting means 7 is in the range below a predetermined value, and at a fixed value when the inlet temperature Tt is in the range over the predetermined value. This enables an increase of pressure resulting from an abnormal temperature rise to be prevented more satisfactorily.

Further, advantageously, the limit temperature setting means 9 may set the maximum permissible temperature at a value proportional to the inlet temperature Tt of the cooling water when the inlet temperature Tt of the cooling water detected by the first temperature detecting means 7 is in the range below a first predetermined value; at a constant value when the inlet temperature Tt is in the range over the first predetermined value but below a second predetermined value higher than the first predetermined value; and at a value inversely proportional to the inlet temperature Tt when the inlet temperature Tt is in the range over the second predetermined value. This enables the increase of pressure caused by an abnormal temperature rise to be prevented even more satisfactorily.

Further, for controlling the amount of heat to minimize a deviation from a value primarily determined by the cooling load, the heating restraining means 10 may be constructed of a stepwise limiting means for limiting the amount of heat stepwise at predetermined intervals.

Operation and effects of the absorption refrigeration unit constructed as described above will be mentioned below. When the temperature of the cooling water measured by the first temperature detecting means 7 is low, the maximum permissible temperature for the high temperature generator 3 is set at a lower level by the limit temperature setting means 9, than when the temperature of the cooling water is high. In a normal operation during which the cooling water is low in temperature, the amount of heat of the high temperature generator 3 is restrained, as compared with in a normal operation during which the cooling water is high in temperature, even if the cooling load is equal in temperature. Accordingly, the amount of heat is reduced by the heating restraining means 10, so long as a temperature in the high temperature generator 3 detected by the second temperature detecting means 8 exceeds the maximum permissible temperature set at a low level. Thus, a surplus refrigerating capacity can be prevented to attain an energy-saving. Besides, in the condition of the cooling water being low in temperature, if the temperature in the high temperature generator 3 is slow in exceeding the maximum permissible temperature at the time of start-up operation and the like, the amount of heat of the high temperature generator 3 is sufficiently applied according to the large cooling load, thereby achieving an improved response.

Furthermore, even in the condition of the cooling water being high in temperature, the amount of heat is reduced by the heating restraining means 10, so long as the temperature of the high temperature generator 3 exceeds the maximum permissible temperature. Thus, the increase of pressure in the high temperature generator 3 can be avoided. Moreover, irrespective of the temperature of the cooling water, the amount of heat is reduced by the heating restraining means 10, so long as the temperature in the high temperature generator 3 exceeds the maximum permissible temperature. Thus, an abnormal pressure increase in the high temperature generator 3 can be avoided also in abnormal conditions such as the case of a large amount of hydrogen gas being generated.

In particular, according to the present invention, since the amount of heat is suppressedly controlled, not on the basis of the temperature in the low temperature generator 4 but on the basis of the temperature in the high temperature generator 3, the following problems can be advantageously avoided. If the limit value is determined on the temperature in the low temperature generator 4, with the temperature in the high temperature generator 3 being higher than the temperature in the low temperature generator 4 from the time of start-up operation, when the temperature in the high temperature generator 3 rises abnormally, there arises a problem. That is, if pressure of combustion gas is in excess of a design value, or a noncondensable gas (e.g. hydrogen) caused by a corrosion is accumulated in equipment, the temperature in the high temperature generator 3, which is designed to be operated with a pressure smaller than or equal to an atmospheric pressure, may be abnormally increased to cause the pressure to rise over the atmospheric pressure.

In addition, the more the temperature rises, the more an aqueous solution of lithium bromide used for an absorbent solution increases in its corrosive action., so that there is a possible risk of corrosion of equipment developing abnormally.

However, according to the present invention, these problems can be avoided and appropriate control can be achieved, because the amount of heat is suppressed on the basis of the temperature in the high temperature generator 3.

BEST MODE FOR CARRYING OUT THE INVENTION

Figure 1:
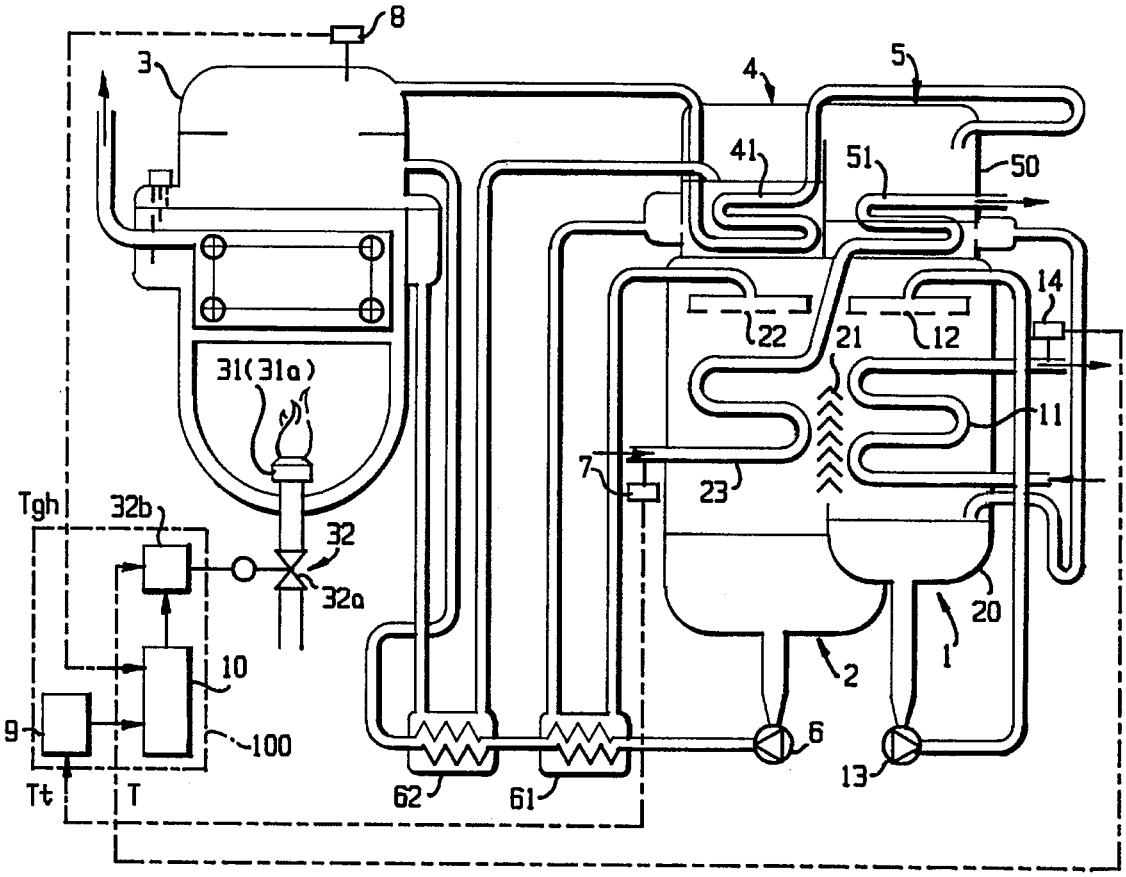
FIG. 1 is a piping drawing showing a preferred embodiment of an absorption refrigeration unit according to the present invention.
Figure 3:
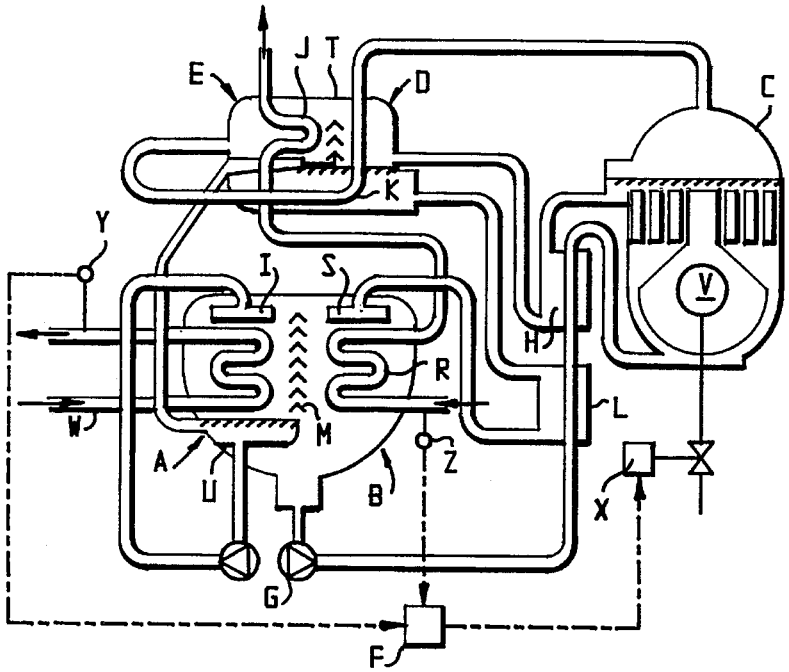
FIG. 3 is a piping drawing of a conventional absorption refrigeration unit and FIG. 4 is a graph showing a control in the conventional absorption refrigeration unit.

FIG. 1 shows a gas firing type double effect absorption refrigeration unit, which comprises an evaporator 1, having a refrigeration applicator 12 and a refrigeration pump 13, for evaporating a refrigerant to take into a water cooling pipe 11 cooled water to be supplied to cooling load an absorber 2 which is disposed in the same single vessel 20, adjacent to the evaporator 1 across a eliminator 21, and is provided with an concentrated solution applicator 22 and a cooling water piping 23; a high temperature generator 3, connected with the absorber 2 through a solution pump 6, a low temperature heat exchanger 61 and a high temperature heat exchanger 62, for generating a refrigerant by a heating source 31 of a burner 31*a* from a diluted solution into which a large amount of refrigerant was absorbed by the absorber 2; a low temperature generator 4, having a heater 4 through which refrigerant vapors generated by the high temperature generator 3 are passed, for generating the refrigerant from an intermediate concentration solution which was regenerated by the high temperature generator 3 and passed through the high temperature heat exchanger 62; and a condenser 5, disposed in a same one vessel 50 together with the low temperature generator 4, for condensing the refrigerant vapors generated by the respective generators 3,4 by means of a cooling water piping 51 arranged in succession to a latter part of the cooling water piping 23 in the absorber 2.

Figure 2:
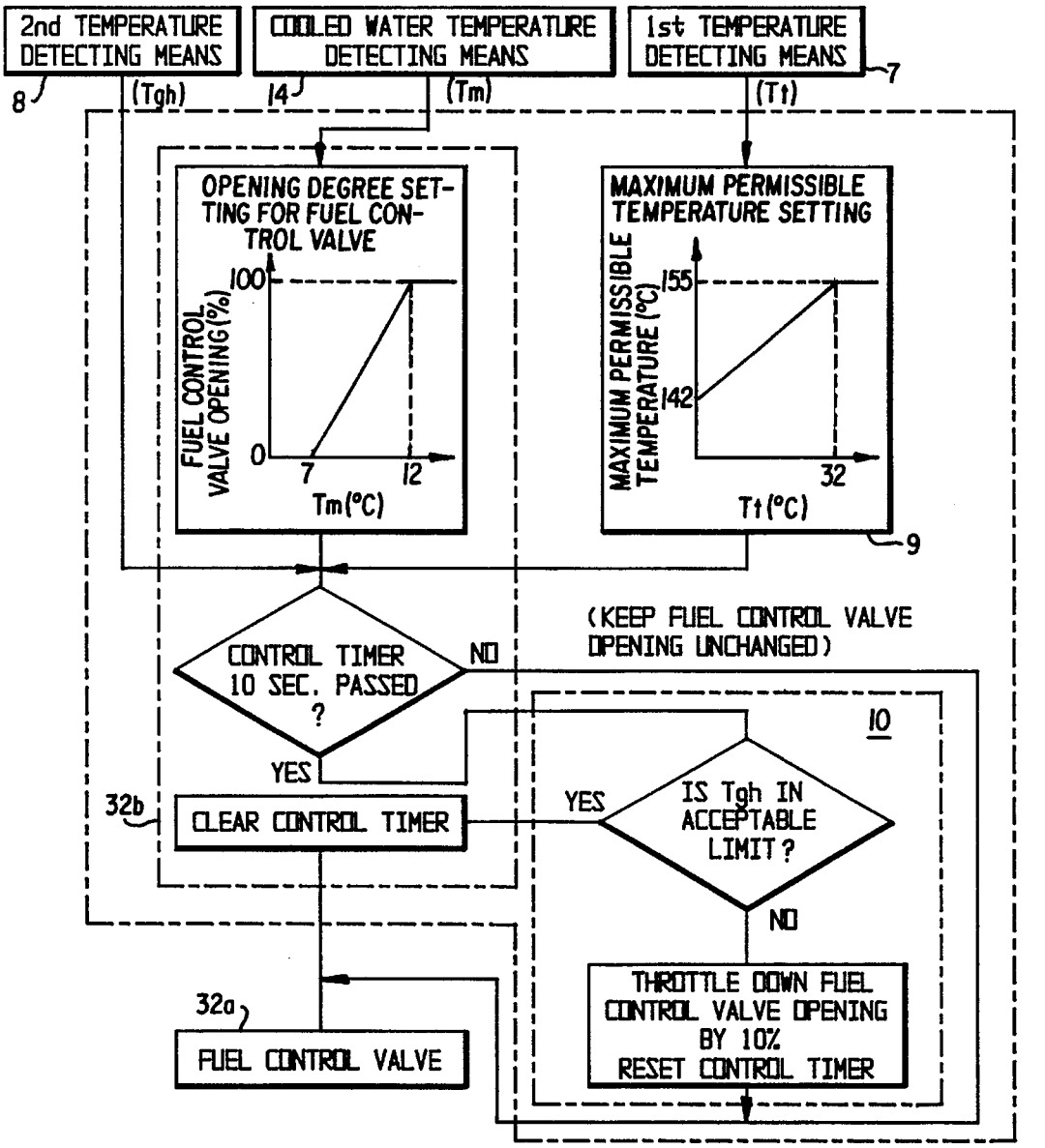
FIG. 2 is a control flow sheet of the invention of FIG. 1.
Figure 4:
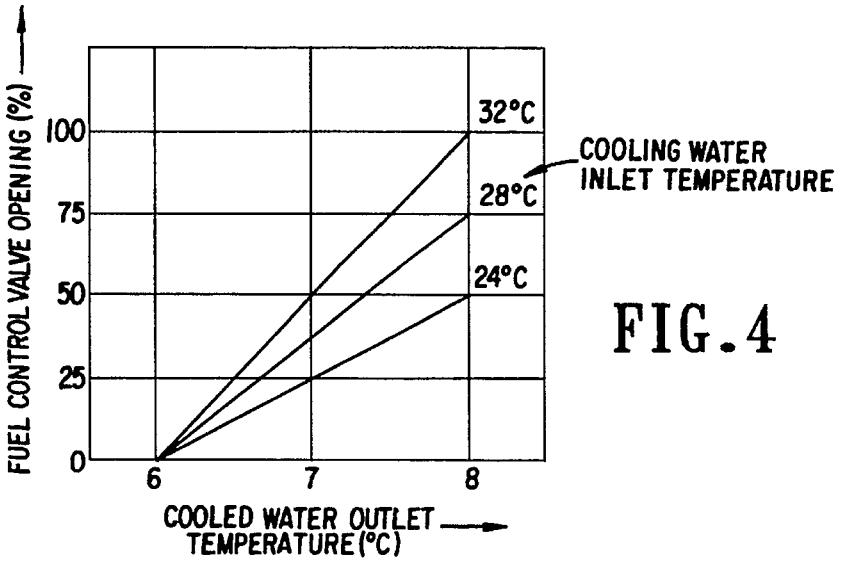

The amount of heat applied by the burner 31*a* provided in the high temperature generator 3 is varied by heating controlling means 32 comprising a fuel control valve 32*a* for controlling a fuel supply to the burner 31*a*. Opening of the fuel control valve 32*a* is adjusted by opening-degree adjusting means 32*b* on the basis of a value detected by cooling load detecting means 32*b* comprising cooled water outlet temperature detecting means 14 provided at an outlet of the water cooling pipe 11, so as to regulate the amount of heat according to the cooling load. To take an example in which a temperature of the cooled water taken into the water cooling pipe 11 is set at for example 7° C.: As shown in FIG. 2, when the temperature of the cooled water Tm detected by the cooled wated outlet temperature detecting means 14 is 7° C. or less, the degree of the opening of the fuel valve 32*a* is reduced to 0% to stop burning when the Tm is 12° C. or more, the degree of the opening of the fuel valve is increased to 100% to conduct a rated burning and when the Tm is in an intermediate range from 7° C. to 12° C., a proportional control is conducted.

The cooling load detecting means may be constructed of means for detecting a difference between an inlet temperature and an outlet temperature of the cooled water, provided at an outlet and inlet of the water cooling pipe 11, instead of said the means 14.

In the above described construction, as shown in FIGS. 1 and 2, there are provided first temperature detecting means 7 for detecting an inlet temperature Tt of the cooling water flowing through the cooling water piping 23 arranged in the absorber 2 and second temperature detecting means 8 for detecting a temperature Tgh in the high temperature generator 3. The temperature detecting means 7,8 are connected with a controller 100 provided with the opening-degree adjusting means 32*b*, in the same manner as the cooled water outlet temperature detecting means 14. The controller 100 may comprise a microcomputer and the like.

Further, there is provided limit temperature setting means 9 for determining a maximum permissible temperature for the high temperature generator 3 according to values detected by the first temperature detecting means 7. Preferably, the limit temperature setting means 9 is so constructed that it can set the maximum permissible temperature at a value proportional to an inlet temperature Tt of the cooling water when the inlet temperature Tt of the cooling water detected by the first temperature detecting means 7 is in the range below a predetermined value and at a fixed value when the Tt is in the range over the predetermined value. For example, as shown in FIG. 2, the limit temperature setting means 9 sets the maximum permissible temperature at 142° C. when the inlet temperature Tt of the cooling water detected by the first temperature detecting means 7 is 19° C. at a constant value of 155° C. when the Tt is 32° C. or more; and at a proportionally variable value when the Tt is in the intermediate range from 19° C. to 32° C. Alternatively, the limit temperature setting means 9 may, for example, set the maximum permissible temperature at 120° C. when the inlet temperature Tt of the cooling water is 20° C.; at a proportionally variable value when the Tt is in the range from 20° C. to 32° C.; at 162° C. when the Tt is 32° C. at a constant value of 162° C. when the Tt is in the range from 32° C. to 34° C.; and at an inversely proportionally variable value when the Tt is in the range over 32° C., e.g., at 155° C. when the Tt is 40° C. In summary, the limit temperature setting means 9 may set the maximum permissible temperature at a value proportional to the inlet temperature Tt of the cooling water when the inlet temperature Tt of the cooling water detected by the first temperature detecting means 7 is in the range below a first predetermined value; at a constant value when the Tt is in the range over the first predetermined value but below a second predetermined value higher than the first predetermined value; and at a value inversely proportional to the inlet temperature Tt when the Tt is in the range over the second predetermined value.

Further, there is provided heating restraining means 10 for restraining an opening of the fuel control valve 32*a* to a degree smaller than that to be determined on the basis of the outlet temperature of the cooled water, when the value detected by the second temperature detecting means 8 exceeds the maximum permissible temperature set by the limit temperature setting means 9. Specifically, as shown in FIG. 2, when a minimum interval, e.g., about ten seconds, predetermined by a control timer to change a degree of openings of the fuel control valve 32*a* has elapsed, a value Tgh detected by the second temperature detecting means 8 is determined on whether it exceeds the maximum permissible temperature set by the limit temperature setting means 9 or not. If the value Tgh exceeds the set maximum permissible temperature, the opening of the fuel control valve 32*a* is throttled down by for example 10% to reduce the amount of heat applied by the burner 31*a*. The heating restraining means 10 may be adapted to limit the amount of heat stepwise at predetermined intervals, or reduce the amount of heat to zero at a time so as to stop burning.

Thus, with the abovementioned construction, in a normal operation during which the temperature of the cooling water detected by the first temperature detecting means 7 is low, the amount of heat is reduced by the heating restraining means 10, compared as in a normal operation during which the temperature of cooling water is high, so long as the temperature of the cooling water exceeds the maximum permissible temperature set at a lower level. Thus, a surplus refrigerating capacity is prevented, thus achieving an energy-saving. Besides, in the condition of the cooling water being low in temperature, if the temperature in the high temperature generator 3 is slow in exceeding the maximum permissible temperature at the time of start-up operation and the like, the amount of heat in the high temperature generator 3 can be sufficiently applied according to the large cooling load, thereby providing an improved response. Further, not only when the temperature of the cooling water is high, but also in abnormal conditions, such as the condition of a large amount of hydrogen gas being generated, the amount of heat is reduced by the heating restraining means 10, so long as the temperature in the high temperature generator 3 exceeds the maximum permissible temperature.

Thus, increase of pressure in the high temperature generator 3 and excessive concentration can be avoided.

Instead of the burner 31*a* used in the above described embodiment, heating steam may be used for the heat source 31.

Industrial Applicability

As described above, the absorption refrigeration unit of the present invention is useful for a double effect absorption refrigeration unit which mainly uses water as a refrigerant and an aqueous solution of lithium bromide as an absorbent solution, respectively, and comprises an evaporator, an absorber, a high temperature generator, a low temperature generator and a condenser.

We claim:

1. An absorption refrigeration unit comprising:

an evaporator for evaporating a refrigerant to take out thermal energy to be supplied to a cooling load, said evaporator being provided with a cooled water piping arranged in it;

an absorber for absorbing the refrigerant evaporated by said evaporator into a solution, said absorber being provided with a cooling water piping arranged in it;

a high temperature generator and a low temperature generator both for generating refrigerant vapor from the solution into which the refrigerant was absorbed by said absorber, said high temperature generator comprising a heat source;

a condenser for condensing the refrigerant vapor generated by the generators;

heating control mean for controlling an amount of heat of said heating source in said high temperature generator to increase or decrease according to variations, large and small, of the cooling load indicated by the temperature of the cooled water flowing through said cooled water piping;

a first temperature detecting means comprising a cooling water inlet temperature detecting means for detecting an inlet temperature of the cooling water flowing through said cooling water piping; and a second temperature detecting means for detecting a temperature of said high temperature generator, said absorption refrigeration unit further comprising:

limit temperature setting means for setting a maximum permissible temperature of said high temperature generator on the basis of only a detected value of the cooling water inlet temperature by said cooling water inlet temperature detecting means in such a manner that within a temperature range of a detected value of the cooling water inlet temperature being below a predetermined value, the maximum permissible temperature is set at a low level when a detected value of the inlet temperature of the cooling water is low and said maximum permissible temperature rises in response to an increase in the detected value of the cooling water inlet temperature; and heat restraining means for giving a command for reducing the amount of heat to said heating control means when a value of the temperature of said high temperature generator detected by the second temperature detecting means exceeds the maximum permissible temperature set by said limit temperature setting means, the detected value of the temperature of the cooling water overrides the detected value of the temperature of the cooled water to give a command for reducing the amount of heat to said heating control means.

2. An absorption refrigeration unit as set forth in claim 1 wherein said heat source is a burner, and said heating control mean is a fuel control valve having an opening which is adjustable to control a fuel supply to said burner.

3. An absorption refrigeration unit as set forth in claim 1 wherein means for detecting the cooling load is cooled water outlet temperature detecting means provided at an outlet of a water cooling pipe arranged in the evaporator.

4. An absorption refrigeration unit as set forth in claim 1 including means for detecting the cooling load comprising means for detecting a difference between an inlet temperature and an outlet temperature of the cooled water flowing through a water cooling pipe arranged in said evaporator.

5. An absorption refrigeration unit as set forth in claim 1 wherein said limit temperature setting means sets the maximum permissible temperature at a value proportional to the inlet temperature of the cooling water when the inlet temperature of the cooling water detected by said first temperature detecting means is in the range below a predetermined value, and at a fixed value when the inlet temperature is in the range above the predetermined value.

6. An absorption refrigeration unit as set forth in claim 1 wherein said limit temperature setting means sets the maximum permissible temperature at a value proportional to the inlet temperature of the cooling water when the inlet temperature of the cooling water detected by said first temperature detecting means is in range below a first predetermined value; at a constant value when the inlet temperature is in range above the first predetermined value but below a second predetermined value higher than the first predetermined value; and at a value inversely proportional to the inlet temperature when the inlet temperature is in a range above the second predetermined value.

7. An absorption refrigeration unit as set forth in claim 1, wherein said heating restraining means is a stepwise limiting means for limiting the amount of heat stepwise at predetermined intervals.

* * * * *